US011598284B2

(12) United States Patent
Larsson

(10) Patent No.: US 11,598,284 B2
(45) Date of Patent: Mar. 7, 2023

(54) RECOVERY OF ENERGY IN RESIDUE GASES

(71) Applicant: SWEDISH STIRLING AB, Västra Frölunda (SE)

(72) Inventor: Gunnar Larsson, Gothenburg (SE)

(73) Assignee: SWEDISH STIRLING AB, Västra Frölunda (SE)

( * ) Notice: Subject to any disclaimer, the term of this patent is extended or adjusted under 35 U.S.C. 154(b) by 0 days.

(21) Appl. No.: 17/414,154

(22) PCT Filed: Dec. 20, 2019

(86) PCT No.: PCT/EP2019/086767
§ 371 (c)(1),
(2) Date: Jun. 15, 2021

(87) PCT Pub. No.: WO2020/128023
PCT Pub. Date: Jun. 25, 2020

(65) Prior Publication Data

US 2022/0065194 A1 Mar. 3, 2022

(30) Foreign Application Priority Data

Dec. 20, 2018 (EP) ..... 18214336

(51) Int. Cl.
*F02G 1/05* (2006.01)
*F02G 1/044* (2006.01)
*F02G 1/055* (2006.01)

(52) U.S. Cl.
CPC ..... *F02G 1/05* (2013.01); *F02G 1/044* (2013.01); *F02G 1/055* (2013.01); *F02G 2254/10* (2013.01); *F02G 2275/00* (2013.01)

(58) Field of Classification Search
CPC . F02G 1/05; F02G 1/044; F02G 1/055; F02G 2254/10; F02G 2275/00
See application file for complete search history.

(56) References Cited

U.S. PATENT DOCUMENTS 3,990,246 A * 11/1976 Wilmers ..... F02G 1/04 60/707
4,045,978 A * 9/1977 Abrahams ..... F02G 1/044 60/521

(Continued)

FOREIGN PATENT DOCUMENTS

EP 0457399 A2 11/1991

OTHER PUBLICATIONS

Carlqvist, et al. "Study of 4-Cylinder, Double-Acting and Hermetically Sealed Stirling Engine," Proceeding of the 25th Intersociety Energy Conversion Engineering Conference. IECEC-90. Reno, Aug. 12-17, 1990. vol. 6, 323-328, Aug. 1990.

(Continued)

*Primary Examiner* — Shafiq Mian
(74) *Attorney, Agent, or Firm* — Hamilton, Brook, Smith & Reynolds, P.C.

(57) ABSTRACT

A system for recovery of energy in residue gases, comprising at least two energy conversion units (1), including a combustion chamber (2) having a fuel inlet (9), and a Sterling engine (4) having a heat exchanger (3) with a set of tubes containing working fluid, a portion of the heat exchanger extending into the combustion chamber (2). The system further comprises a pressure control system including a high-pressure reservoir (21) of working fluid, a low-pressure reservoir (22) of working fluid, a pressure pump (23) configured to maintain a pressure difference between the reservoirs, and a control arrangement (31, 32, 33) to regulate a pressure in the fluid circuit.

20 Claims, 5 Drawing Sheets

(56) References Cited

U.S. PATENT DOCUMENTS

| | | | | |
|---|---|---|---|---|
| 4,824,149 | A * | 4/1989 | Reuchlein | H02K 35/02 290/1 R |
| 5,074,114 | A * | 12/1991 | Meijer | F02G 5/02 290/1 R |
| 5,172,784 | A * | 12/1992 | Varela, Jr. | B60L 50/62 180/65.265 |
| 7,308,787 | B2 * | 12/2007 | LaRocque | F02G 1/055 60/524 |
| 2004/0033140 | A1 * | 2/2004 | Jensen | F02M 21/0245 417/1 |
| 2010/0269789 | A1 | 10/2010 | Jensen et al. | |
| 2011/0088386 | A1 * | 4/2011 | Howard | F02G 1/043 60/525 |
| 2018/0038310 | A1 * | 2/2018 | Xiao | F24S 90/00 |

OTHER PUBLICATIONS

International Search Report for PCT/EP2019/086767, entitled "Recovery of Energy in Residue Gases," dated Mar. 18, 2020.
European Search Report for EP 18214336.2, entitled "A System for Recovery of Energy in Residue Gases," dated Jun. 19, 2019.

* cited by examiner

RECOVERY OF ENERGY IN RESIDUE GASES

This application is the U.S. National Stage of International Application No. PCT/EP2019/086767, filed Dec. 20, 2019, which designates the U.S., published in English, and claims priority under 35 U.S.C. § 119 or 365(c) to EP Application No. 18214336.2, filed Dec. 20, 2018. The entire teachings of the above applications are incorporated herein by reference.

FIELD OF THE INVENTION

The present invention relates to recovery of energy in residue gases generated in an industrial process, such as smelting plants. Specifically, the invention relates to the use of Stirling engines for such energy recovery.

BACKGROUND OF THE INVENTION

In many industries, various processes result in residue gas, often including a mix of burnable gases. One specific example is the reduction process in smelting plants, where carbon reacts with oxygen in metal oxide, in order to obtain pure metal with CO as a rest product. Further, due to the enormous heat, water present in the metal ore is split into hydrogen ($H_2$) and oxygen. The mixing ratio of CO and $H_2$ will depend on the amount of moisture in the ore.

Conventionally, such residue gases are used to some extent in various heating applications in the smelting plant. However, typically a large portion (e.g. 40% or more) of the residue gas cannot be used, and is then simply burned in a flare stack in order to get rid of the toxic CO.

Due to the large variation of $H_2$ content, it is challenging to recover energy from the residue gas. For example, combustion engines are not feasible, as the ignition cannot be controlled when the $H_2$ is mixed with oxygen and compressed. Also, the gas may contain contaminations which may damage a combustion engine, for examples particles that may melt and stick to the cylinder and valves.

There is thus a need for an improved way to recover energy in reside gases from industrial processes.

GENERAL DISCLOSURE OF THE INVENTION

It is an object of the present invention to address the problems mentioned above, and provide an improved way to recover energy in reside gases from industrial processes.

According to a first aspect to the present invention, this and other objects are achieved by a system for recovery of energy in residue gases generated in an industrial process, comprising at least two energy conversion units, each unit including a combustion chamber having a fuel inlet configured to receive a flow of residue gas for combustion in the chamber, and a Sterling engine configured to convert heat from the combustion chamber into mechanical energy, the Stirling engine having a fluid circuit containing a compressible working fluid, the circuit including a heat exchanger with a set of tubes, a portion of the heat exchanger extending into the combustion chamber. The system further comprises a pressure control system including a high-pressure reservoir of working fluid, a low-pressure reservoir of working fluid, a pressure pump connected between the high pressure reservoir and the low pressure reservoir and configured to maintain a pressure difference between the reservoirs, and a control arrangement configured to place the fluid circuit of each Stirling engine in fluid connection with one of the high-pressure reservoir and the low-pressure reservoir to regulate a pressure in the fluid circuit.

It is well known that a Stirling engine can be used to convert heat from an available heat source, such as a combustion process, to mechanical (rotational) energy. According to the present invention, a heat exchanger of a Stirling engine, including a set of tubes for carrying a working fluid, e.g. hydrogen gas, extends into a combustion chamber, where residue gas from the industrial plant is supplied and combusted.

The system includes a plurality of Stirling engines (at least two, but potentially a larger number), each associated with a separate combustion chamber. Each Stirling engine and its combustion chamber form a modular energy conversion unit, thereby making it possible to scale the system to a specific industrial process, by simply including more or fewer conversion units (combustion chambers with associated Stirling engines).

In order to maintain a high energy conversion ratio in a Stirling engine, it is important to adjust the pressure of the internal working medium in dependence of the power (amount and composition of fuel) input to the combustion chamber. The higher input power (more fuel) the higher pressure is required.

In a conventional Stirling engine, the pressure of the working medium is typically controlled by a pressure pump integrated into the Stirling engine. The present inventors have realized that, when combining a plurality of Stirling engines in order to achieve a desired combustion capacity, it is advantageous to have a common pressure control system for control of the pressure of the working medium in all Stirling engines.

According to the present invention, such a pressure control system includes a high-pressure reservoir, a low pressure reservoir, and a pressure pump connected to maintain a relatively higher pressure in the high-pressure reservoir. The system also includes a control arrangement to regulate a pressure in the fluid circuits of the Stirling engines.

The present invention reduces cost, as only one pressure pump is required for a plurality of Stirling engines. Further, the high pressure reservoir enables use of a smaller pressure pump, as short term pressure increase can be provided by the high-pressure reservoir. Also, as the pressure pump according to the invention can be operated independently from the output shaft of the Stirling engine(s), there will be less parasitic power consumption.

According to one embodiment, the control arrangement includes a separate pressure controller (e.g. set of valves and associated control circuitry) connected to each Stirling engine. Thereby, the pressure in each fluid circuit can be controlled individually, in dependence on the conditions in the Stirling engine, such as the temperature of the working fluid. For example, temperature sensors may be provided on the heat exchanger and connected to provide the pressure controller with a control signal indicative of the temperature of the working fluid. Thereby, the pressure in each fluid circuit can be optimized based on the working fluid temperature.

Alternatively, the control arrangement includes one single pressure controller (e.g. set of valves and associated control circuitry) connected to all Stirling engines. Thereby, the pressure in all fluid circuits can be controlled with one single pressure controller, reducing cost and complexity.

As a consequence of such "cluster" control, each Stirling engine cannot be controlled individually, and may therefore not operate at maximum efficiency. On the other hand, the number of valves is reduced significantly.

Similarly, there are various options for the supply of residue gas to the combustion chambers. In one embodiment, each fuel inlet is connected to a separate fuel flow controller (e.g. valve and control circuitry), configured to regulate the flow of residue gas through the fuel inlet. This allows individual control of the fuel supply to each combustion chamber to optimize performance. Also, in case of a fault condition in one unit, fuel supply to this unit may be shut off while other units continue to operate.

Alternatively, in another embodiment, all fuel inlets are connected to a common fuel flow controller (e.g. valve and control circuitry) configured to regulate the flow of residue gas through all fuel inlets. In this case, the supply of fuel for all combustion chambers can be controlled by one single flow controller, thereby reducing cost and complexity. The fuel flow into each combustion chamber will depend on the pressure drop from the common fuel valve to the respective combustion chamber. If the flow of fuel is different into different combustion chambers, the common flow controller may control the fuel flow based on the largest flow of fuel. Such control may be used to achieve balancing of all energy conversion units for optimal performance.

BRIEF DESCRIPTION OF THE DRAWINGS

The present invention will be described in more detail with reference to the appended drawings, showing currently preferred embodiments of the invention.

DETAILED DESCRIPTION OF PREFERRED EMBODIMENTS

Figure 1A:
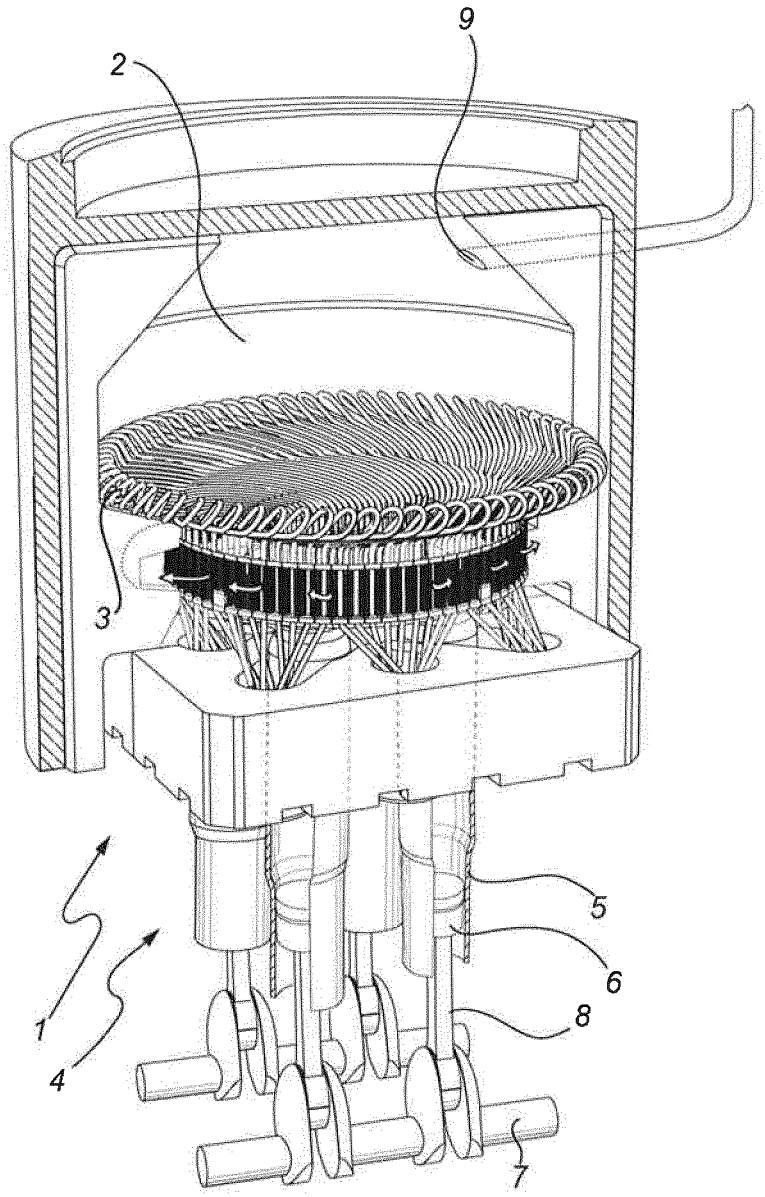
FIG. 1*a* shows a perspective view of an example of a energy conversion unit.

FIG. 1*a* shows an energy conversion unit 1 including a combustion chamber 2, a heat exchanger 3, and a Stirling engine 4 having one or several cylinders 5 each having a piston 6 connected to an output shaft 7 by means of a rod 8. A fuel inlet 9 is provided for inlet of gas fuel to be burned in the chamber 2.

The components and working principles of the Stirling engine are known in the art, and will not be described in detail here. However, in brief, a Stirling engine moves a working fluid (e.g. hydrogen gas) back and forth between a cold side and a warm side of a cylinder. On the warm side, the working fluid expands, thus operating the piston in the cylinder. On its path between the cold side and the warm side, the working fluid is heated. During operation of the Stirling engine, the working fluid pressure thus alternates between a high pressure (during the compression stage) and a low pressure (during the expansion stage). As an example, the pressure ratio may be 1 to 1.6.

In the present example, the heating of working fluid is accomplished by the heat exchanger 3, which comprises a set of tubes extending into the combustion chamber. As fuel is burned in the combustion chamber, the working fluid in the heat exchanger is heated before reaching the warm side of the cylinder.

Figure 1B:
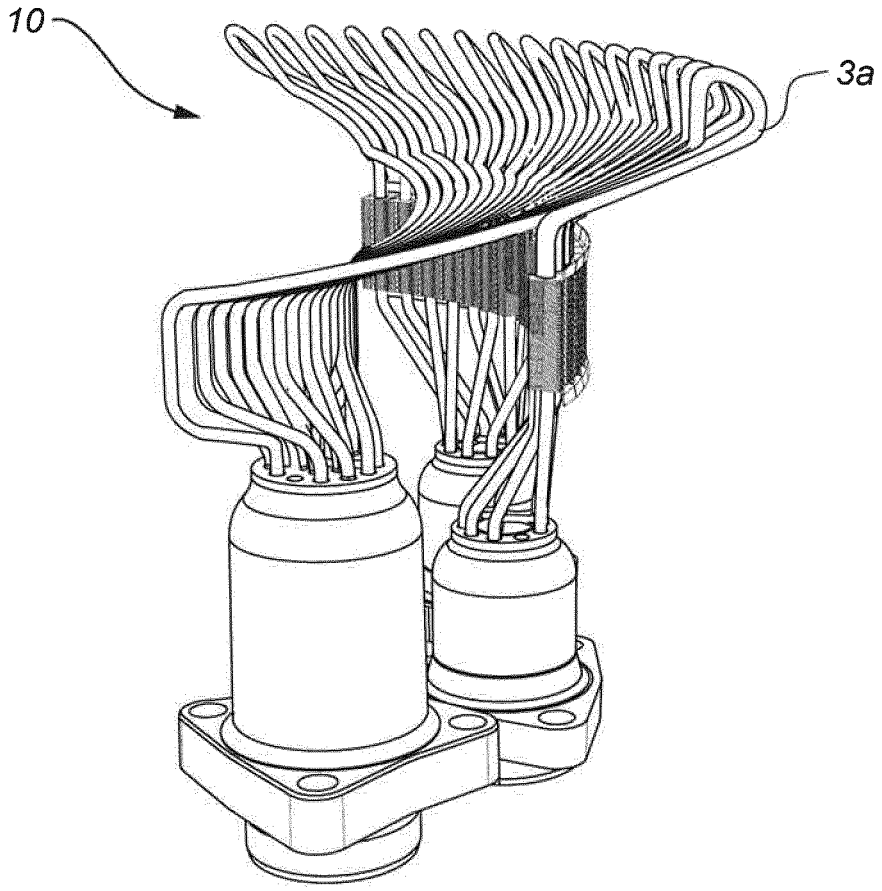
FIG. 1*b* shows one working fluid circuit of the Stirlign engine in FIG. 1*a*.

The illustrated Stirling engine 4 comprises four cylinders 5, each associated with one section 3*a* of the heat exchanger 3, as shown in FIG. 1*b*. In principle, each cylinder 5 and associated part 3*a* of the heat exchanger 3 form a separate working fluid circuit 10. Typically, however, these fluid circuits are connected, such that each four-cylinder Stirling engine has only one single working fluid circuit 10.

Figure 2:
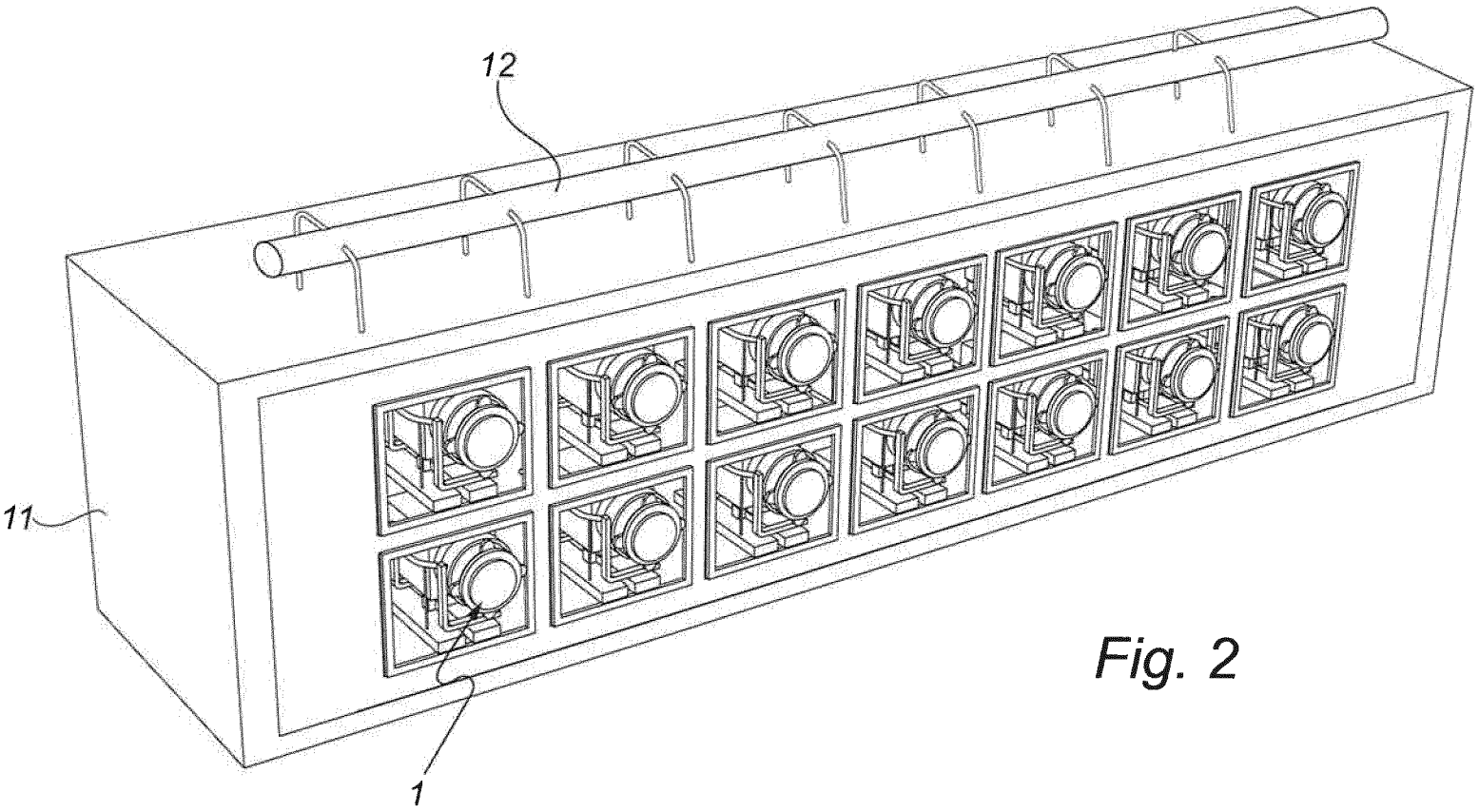
FIG. 2 shows a modular system of energy conversion units according to FIG. 1.

The total output power of the Stirling engine 4 in FIG. 1*a* is in the order of a few tens of kW, e.g. 30 kW. In order to handle a flow of residue gas from an industrial process, a significantly higher power is required, e.g. in the order of several 100 kW. FIG. 2 shows a modular system including a plurality of energy conversion units 1 arranged in a suitable supporting housing 11. In the illustrated example, fourteen units a 30 kW are arranged to provide a total power of over 400 kW. Each unit 1 in the system includes one Stirling engine and one combustion chamber (similar in principle to the unit in FIG. 1*a*), and is configured to receive and burn a gas fuel such as residue gas from an industrial process. The gas fuel is provided in a supply pipe 12, which branches off to each combustion chamber. The Stirling engines are connected to one or several output shafts (not shown in FIG. 2), and the modular system is thus configured to convert chemical energy in the gas fuel to mechanical (rotational) energy. The output shaft(s) may be connected to an electrical generator (not shown) for generation of electrical energy. The generator may be connected to a local energy storage, or be connected to supply power to the mains power grid.

One specific aspect of the operation of a Stirling engine is that the pressure of the working fluid preferably should be adjusted based on the input power. With higher input power, more gas (i.e. higher pressure) is required to absorb the power. In principle, it is advantageous to keep the temperature of the working fluid as high as possible. At the same time, the working fluid must be able to dissipate sufficient heat from the heat exchanger, to prevent damaging the tubes of the heat exchanger. Therefore, control of the working fluid pressure is typically done based on working fluid temperature. When the temperature increases, pressure is increased and vice versa.

In a practical example, the temperature in the combustion chamber may be as high as 2000 degrees Celsius. In order to prevent damage of the tubes of the heat exchanger, it has been found that the working fluid temperature should preferably not exceed around 750 degrees Celsius. The skilled person will understand that the appropriate working fluid temperatures will depend on several design parameters, such as choice of material and geometrical design of the heat exchanger.

In order to allow working fluid pressure control, a conventional Stirling engine may include a set of non-return valves to separate the working fluid circuit(s) into a high pressure side and a low pressure side. Further, a discharge valve is connected to the high pressure side and operated to reduce pressure in the working fluid circuit by discharging working fluid, and a supply valve is connected to the low pressure side and operated to increase the working fluid pressure by connecting the working fluid circuit to a high pressure tank. Further, a pressure pump (compressor) is connected between the discharge valve and the high pressure tank, and configured to increase the pressure of the discharged working fluid. The pressure pump may also be connected to an additional working fluid storage, to enable compensating any leakage in the system. The compressor may be operated directly by the output shaft of the Stirling engine, leading to a compact design. However, such design also implies that the compressor is always running, thus consuming part of the engine output power.

An emergency (or short circuit) valve is typically provided to enable short circuit of the high pressure side and low pressure side of the Stirling engine. Such a short circuit will immediately stop the Stirling engine, and may be required in case of a no-load condition (e.g. malfunction or disconnection of an electrical generator connected to the output shaft).

Figure 3:
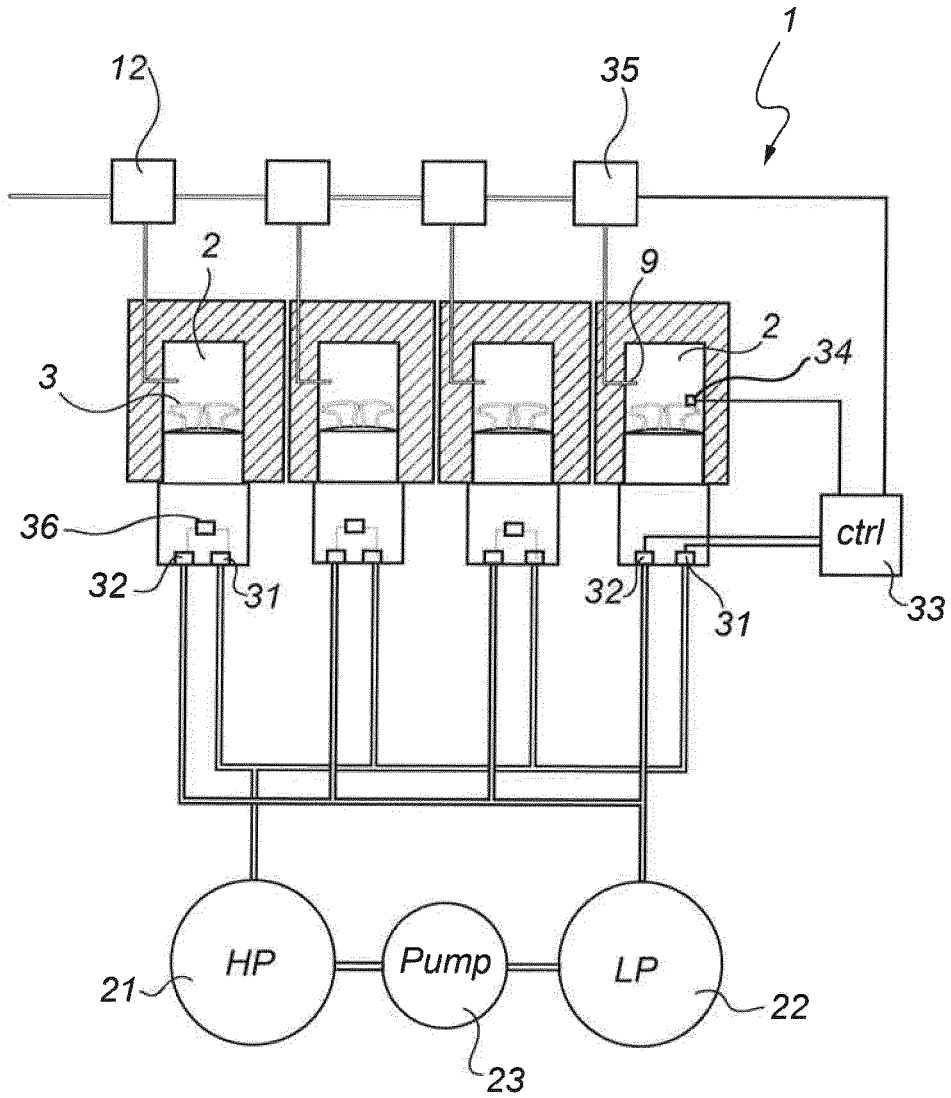
FIG. 3 shows schematically control of working fluid pressure in a set of Stirling engines according to a first embodiment of the present invention.
Figure 4:
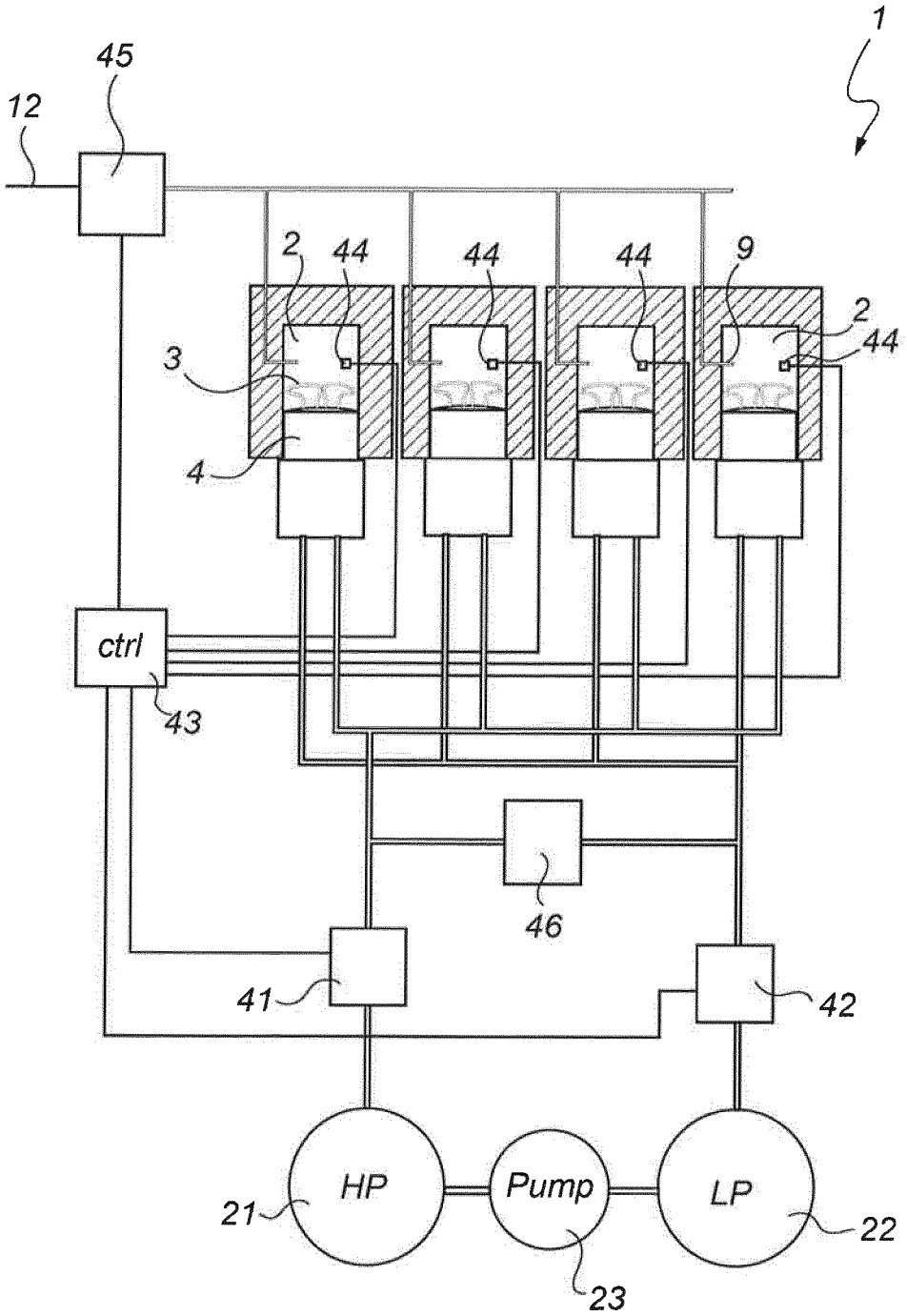
FIG. 4 shows schematically control of working fluid pressure in a set of Stirling engines according to a second embodiment of the present invention.

According to the present invention, the pressure pump directly connected to the output shaft of the Stirling engine is eliminated, leading to a significantly reduced cost for the Stirling engine. Instead, and as illustrated in FIGS. 3 and 4, each Stirling engine in the modular system is connected to a common high-pressure reservoir 21 and a common low-pressure reservoir 22. A pressure pump 23 is arranged between the low pressure reservoir and high pressure reservoir, to maintain a pressure difference, and thereby maintaining the pressure in the high pressure reservoir.

According to a first embodiment, illustrated in FIG. 3 for the case of four energy conversion units 1, each Stirling engine 4 is still provided with two valves (supply valve 31 connected to the low pressure side and discharge valve 32 connected to the high pressure side) similar to the conventional approach. In this embodiment, however, the supply valve 31 is connected to the high-pressure reservoir 21, while the discharge valve 32 is connected to the low-pressure reservoir 22. An emergency valve 36 (shown only for the unit 1 to the left in FIG. 3) is also provided between the high pressure side and low pressure side, to allow a short circuit of the high and low pressure sides, thereby effectively stopping the Stirling engine.

The operation of each pair of valves 31, 32 is controlled by a controller 33, which is configured to operate the valves in order to keep the working fluid at a pressure which ensures high efficiency without damaging the heat exchanger 3. A set of temperature sensors 34 may be arranged on the tubes of the heat exchanger 3. For example, the temperature sensors may be arranged in capsules soldered to the tubes. Due to the significant circulation of working fluid, the temperature of the tube will provide a reliable indication of the working fluid temperature. The sensors 34 provide a signal indicative of the temperature to the controller 33. In the present example, as many as 16 sensors may be provided on various places on the heat exchanger 3. For simplicity, the controller 33 and sensor 34 are only illustrated for the unit 1 to the right in FIG. 3.

The combustion chambers are provided with fuel, here residue gas from an industrial process, through a supply pipe 12. The pipe is connected to a fuel inlet 9 of each combustion chamber 2 via a fuel valve 35.

The controller 33 of each unit 1 may be connected to operate also the associated fuel valve 35, to provide an even better match of the pressure of the working fluid and input power, thus optimizing the energy conversion efficiency of each Stirling engine.

According to a second embodiment, illustrated in FIG. 4 for the case of four energy conversion units, the valves of each Stirling engine are removed, and replaced by one single pair of valves 41, 42, common for all Stirling engines in the modular system. The supply valve 41 connects all working fluid circuits to the high pressure reservoir 21, while the discharge valve 42 connects all fluid circuits to the low pressure reservoir 22. An emergency valve 46 is connected between the high and low pressure sides.

A controller 43 is connected to the valves 41, 42, and is configured to operate the valves 41, 42 to maintain a desired pressure in the working fluid circuits 10. Similar to the embodiment in FIG. 3, one or several sensors 44 may be arranged on the tubes of heat exchanger 3, and connected to provide the controller 43 with information about the temperature of the working fluid. The controller 43 and the two valves 41, 42 control the pressure of the working fluid in all circuits 10. All Stirling engines are thus controlled as one cluster, and the control of this embodiment may be referred to "cluster control".

In the embodiment in FIG. 4, also the fuel supply is controlled by "cluster" control, and the individual fuel valves 35 in FIG. 3 have been replaced by one single valve 45, connecting the supply pipe 12 to all fuel inlets 9. The valve may have a separate controller (not shown), or be controlled by the controller 43.

Based on the temperature information received from all combustion chambers the controller 43 determines an appropriate working fluid pressure. In this embodiment it is no longer possible to achieve an optimal working fluid pressure in each Stirling engine. Instead, the controller 43 is adjust the working fluid pressure based on the highest working fluid temperature in order to ensure that the associated heat exchanger 3 is not overheated and damaged. Depending on the temperature in all chambers, it may further be advantageous to adjust the supply of residue gas through valve 45, to further improve efficiency. The final fuel supply to each combustion chamber will depend on the pressure drop from the valve 45 to the respective combustion chamber, e.g. caused by the length and dimensions of the pipes connecting the respective combustion chamber with the valve 45. Throttles or other types of rudimentary flow control may be provided at each fuel inlet, to allow simple flow control.

As an intermediate solution, the cluster control of working fluid pressure in FIG. 4 may be combined with individual control of fuel supply as shown in FIG. 3. In a situation where the working fluid pressure in one or several Stirling engines deviates significantly from the optimal pressure, the efficiency can then possibly be improved by changing the rate of fuel supply into that particular combustion chamber.

The person skilled in the art realizes that the present invention by no means is limited to the preferred embodiments described above. On the contrary, many modifications and variations are possible within the scope of the appended claims. For example, the individual working fluid pressure control in FIG. 3 may be combined with cluster control of the fuel in FIG. 4. Further, the complete modular system, e.g. the system in FIG. 2, may comprise two or more "clusters", the working fluid pressure of each cluster being controlled by one controller and one set of valves.

The invention claimed is:

1. A system for recovery of energy in residue gases generated in an industrial process, comprising:

at least two energy conversion units, each unit including:

a combustion chamber having a fuel inlet configured to receive a flow of residue gas for combustion in said chamber, and a Sterling engine configured to convert heat from the combustion chamber into mechanical energy, the Stirling engine having a separate fluid circuit containing a compressible working fluid, said fluid circuit including a heat exchanger with a set of tubes, a portion of said heat exchanger extending into the combustion chamber; and a pressure control system including:

a high-pressure reservoir of working fluid, a low-pressure reservoir of working fluid, a pressure pump connected between said high pressure reservoir and said low pressure reservoir and configured to maintain a pressure difference between said reservoirs, and a control arrangement common to the at least two energy conversion units and configured to place the fluid circuit of each Stirling engine in fluid connection with one of said high-pressure reservoir and said low-pressure reservoir to regulate a pressure in each separate fluid circuit.

2. The system in claim 1, wherein each Stirling engine has a supply valve connecting a low pressure side of the fluid circuit with the high-pressure reservoir, and a discharge valve connecting a high pressure side of the fluid circuit with the low-pressure reservoir, and wherein the control arrangement includes a separate pressure controller for each Stirling engine, said pressure controller being configured to control said supply valve and discharge valve.

3. The system in claim 1, wherein the control arrangement includes a common supply valve for connecting the high-pressure reservoir to a low-pressure side of the fluid circuits of all Stirling engines, a common discharge valve for connecting the low-pressure reservoir to a high-pressure side of the fluid circuits of all Stirling engines, and one single pressure controller configured to control said common supply valve and said common discharge valve.

4. The system in claim 1, wherein each heat exchanger is provided with at least one temperature sensor connected to provide a temperature signal to the pressure controller of the Stirling engine associated with the combustion chamber.

5. The system in claim 1, wherein each fuel inlet is connected to a separate fuel valve, configured to regulate the flow of residue gas into the fuel inlet.

6. The system in claim 1, wherein all fuel inlets are connected to a common fuel flow valve configured to regulate the flow of residue gas into all fuel inlets.

7. The system in claim 1, wherein each Stirling engine has equal power capacity.

8. The system in claim 7, wherein each Stirling engine has substantially equal design.

9. The system in claim 1, wherein each Stirling engine includes a plurality of cylinders, each cylinder associated with a working fluid sub-circuit, said working fluid sub-circuits being connected to form the separate fluid circuit of the respective Stirling engine.

10. The system in claim 9, wherein each Stirling engine includes four cylinders.

11. A system for recovery of energy in residue gases generated in an industrial process, comprising:

at least two energy conversion units, each unit including:

a combustion chamber having a fuel inlet configured to receive a flow of residue gas for combustion in said chamber, and a Sterling engine configured to convert heat from the combustion chamber into mechanical energy, the Stirling engine having a separate fluid circuit containing a compressible working fluid, said fluid circuit including a heat exchanger with a set of tubes, a portion of said heat exchanger extending into the combustion chamber; and a pressure control system including:

a high-pressure reservoir of working fluid, a low-pressure reservoir of working fluid, a pressure pump connected between said high pressure reservoir and said low pressure reservoir and configured to maintain a pressure difference between said reservoirs, and a control arrangement configured to place the fluid circuit of each Stirling engine in fluid connection with one of said high-pressure reservoir and said low-pressure reservoir to regulate a pressure in each separate fluid circuit, wherein the control arrangement includes a common supply valve for connecting the high-pressure reservoir to a low-pressure side of the fluid circuits of all Stirling engines, a common discharge valve for connecting the low-pressure reservoir to a high-pressure side of the fluid circuits of all Stirling engines, and one single pressure controller configured to control said common supply valve and said common discharge valve.

12. The system in claim 11, wherein each heat exchanger is provided with at least one temperature sensor connected to provide a temperature signal to the pressure controller of the Stirling engine associated with the combustion chamber.

13. The system in claim 11, wherein each Stirling engine has equal power capacity.

14. The system in claim 13, wherein each Stirling engine has substantially equal design.

15. The system in claim 11, wherein each Stirling engine includes a plurality of cylinders, each cylinder associated with a working fluid sub-circuit, said working fluid sub-circuits being connected to form the separate fluid circuit of the respective Stirling engine.

16. A system for recovery of energy in residue gases generated in an industrial process, comprising:

at least two energy conversion units, each unit including:

a combustion chamber having a fuel inlet configured to receive a flow of residue gas for combustion in said chamber, and a Sterling engine configured to convert heat from the combustion chamber into mechanical energy, the Stirling engine having a separate fluid circuit containing a compressible working fluid, said fluid circuit including a heat exchanger with a set of tubes, a portion of said heat exchanger extending into the combustion chamber; and a pressure control system including:

a high-pressure reservoir of working fluid, a low-pressure reservoir of working fluid, a pressure pump connected between said high pressure reservoir and said low pressure reservoir and configured to maintain a pressure difference between said reservoirs, and a control arrangement configured to place the fluid circuit of each Stirling engine in fluid connection with one of said high-pressure reservoir and said low-pressure reservoir to regulate a pressure in each separate fluid circuit, wherein all fuel inlets are connected to a common fuel flow valve configured to regulate the flow of residue gas into all fuel inlets.

17. The system in claim 16, wherein each heat exchanger is provided with at least one temperature sensor connected to provide a temperature signal to the pressure controller of the Stirling engine associated with the combustion chamber.

18. The system in claim 16, wherein each Stirling engine has equal power capacity.

19. The system in claim 18, wherein each Stirling engine has substantially equal design.

20. The system in claim 16, wherein each Stirling engine includes a plurality of cylinders, each cylinder associated with a working fluid sub-circuit, said working fluid sub-circuits being connected to form the separate fluid circuit of the respective Stirling engine.

* * * * *